US006665954B2

(12) United States Patent
Chen

(10) Patent No.: US 6,665,954 B2
(45) Date of Patent: Dec. 23, 2003

(54) BREATHABLE RUBBER BOOT

(76) Inventor: Eddie Chen, 9F, No. 201, Sec. 1, Taichung-Kang Rd., Taichung City (TW)

( * ) Notice: Subject to any disclaimer, the term of this patent is extended or adjusted under 35 U.S.C. 154(b) by 156 days.

(21) Appl. No.: 10/062,493

(22) Filed: Feb. 5, 2002

(65) Prior Publication Data

US 2003/0145484 A1 Aug. 7, 2003

(51) Int. Cl.[7] ..... A43B 1/10; A43B 7/06; A43B 23/06

(52) U.S. Cl. ..... 36/3 R; 36/45; 36/55; 36/3 A

(58) Field of Search ..... 36/3 R, 3 A, 4, 36/84, 102, 45, 48, 51, 55

(56) References Cited

U.S. PATENT DOCUMENTS

D10,959 S * 12/1878 Kenz et al. ..... 36/4
556,801 A * 3/1896 Bollinger ..... 36/4
1,616,254 A * 2/1927 De Suarez ..... 36/3 R
3,040,454 A * 6/1962 Topper et al. ..... 36/3 R
3,657,757 A * 4/1972 Vilder ..... 36/4
4,222,183 A * 9/1980 Haddox ..... 36/45
4,599,810 A * 7/1986 Sacre ..... 36/55
5,357,689 A * 10/1994 Awai ..... 36/3 A
RE34,890 E * 4/1995 Sacre ..... 36/55

* cited by examiner

*Primary Examiner*—Anthony D. Stashick
(74) *Attorney, Agent, or Firm*—Baker Botts L.L.P.

(57) ABSTRACT

A boot includes a shell having a foot portion and an upper. The shell is composed of a waterproof first part and at least one non-waterproof air-pervious second part. The second part includes upper and lower margins, and two opposite side margins connected to the upper and lower margins. The second part is connected to the first part at least along the side margins and the lower margin. The first part is made of a waterproof stretchable material at least in the upper. A waterproof air-pervious lining is attached to the second part along the upper, lower and side margins. Waterproof seam sealing members are disposed along connection seams between the first and second parts and the lining.

13 Claims, 6 Drawing Sheets

BREATHABLE RUBBER BOOT

BACKGROUND OF THE INVENTION

1. Field of the Invention

The invention relates to a boot, more particularly to a boot having a part made of a waterproof material, such as a waterproof stretchable rubber and another part made of an air-pervious material, such as a fabric or leather.

2. Description of the Related Art

Rubber boots, such as neoprene knee boots, are generally used by hunters and farmers for their activities in forests, or muddy and watery environments. FIG. 1 shows an example of a neoprene knee boot 1 which is entirely made of a neoprene rubber. The neoprene knee boot 1 is not only waterproof but is also soft and stretchable so that it permits the user to kneel down and work on the ground. However, since the knee boot 1 is not provided with any tongue, lacing and eyelets so as to avoid difficulties in cleaning, the size of the knee boot 1 at the ankle part has to be designed particularly and accurately. If the size of the boot is large, the boot can easily slip from the foot. If the size is small, the boot cannot be worn. Moreover, since the neoprene rubber is air impervious, it does not allow the foot to breathe, and the foot can get wet due to perspiration vapor condensed inside the boot.

SUMMARY OF THE INVENTION

An object of the present invention is to provide a waterproof rubber boot which is not only soft and stretchable but is also air permeable to permit the user's foot to breathe.

Accordingly, a boot according to the present invention comprises: a shell which includes a foot portion with a bottom end, and an upper connected to the foot portion opposite to the bottom end, the upper having a top open end opposite to the foot portion, the shell being composed of a waterproof first part and at least one non-waterproof second part, the second part having an upper margin, a lower margin lower than the upper margin, and two opposite side margins connected to the upper and lower margins, the first part being connected to the second part at least along the side margins and the lower margin; the first part being made of a waterproof stretchable material at least in the upper, the second part being made of a non-waterproof air-pervious material; a waterproof air-pervious lining underlying the second part and attached to the second part along the side margins and the upper and lower margins; connection seams resulting from the connection of the first part and the lining to the second part; and waterproof seam sealing members disposed along the connection seams.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
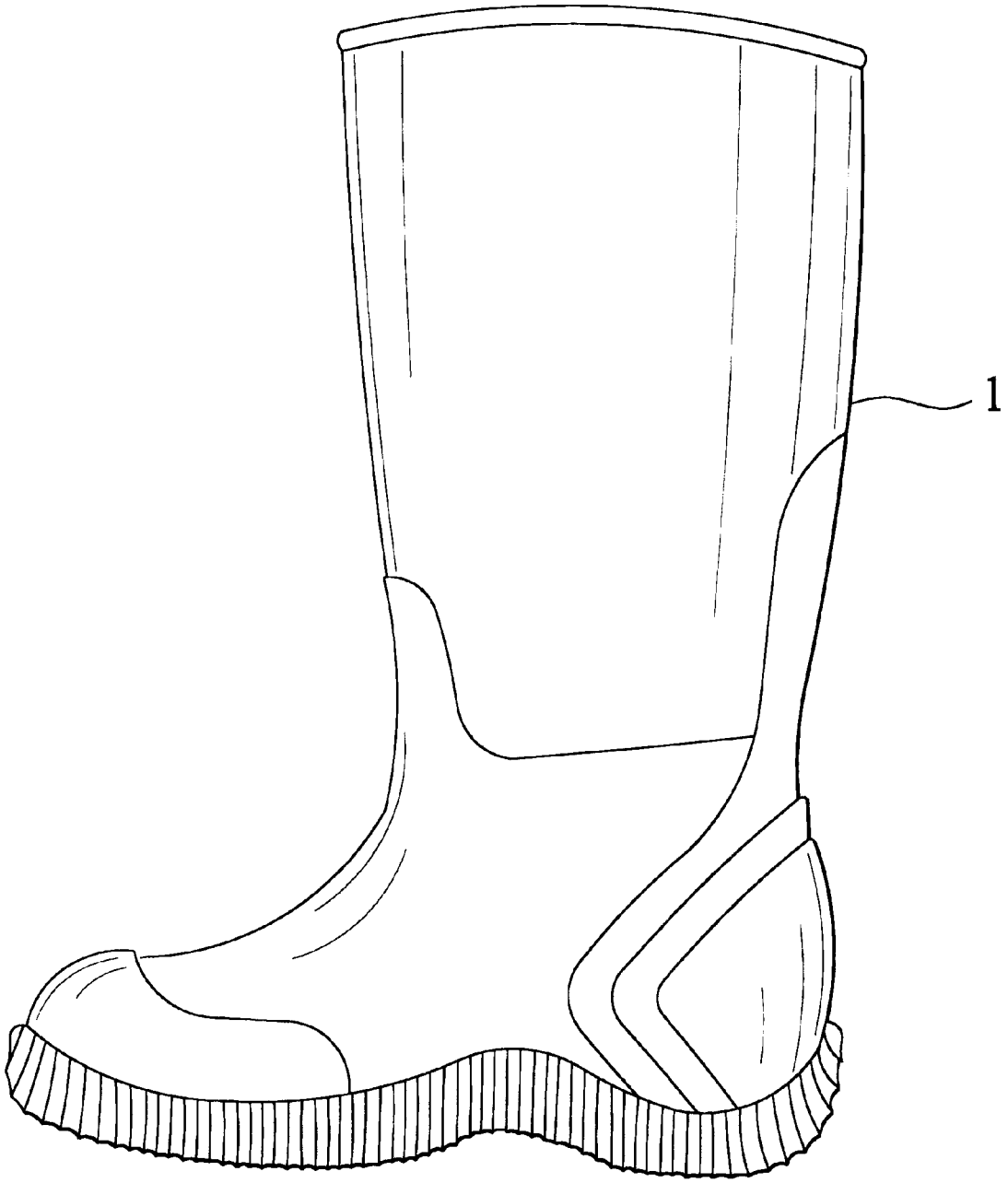
FIG. 1 PRIOR ART
FIG. 1 shows a boot in the prior art.
Figure 2:
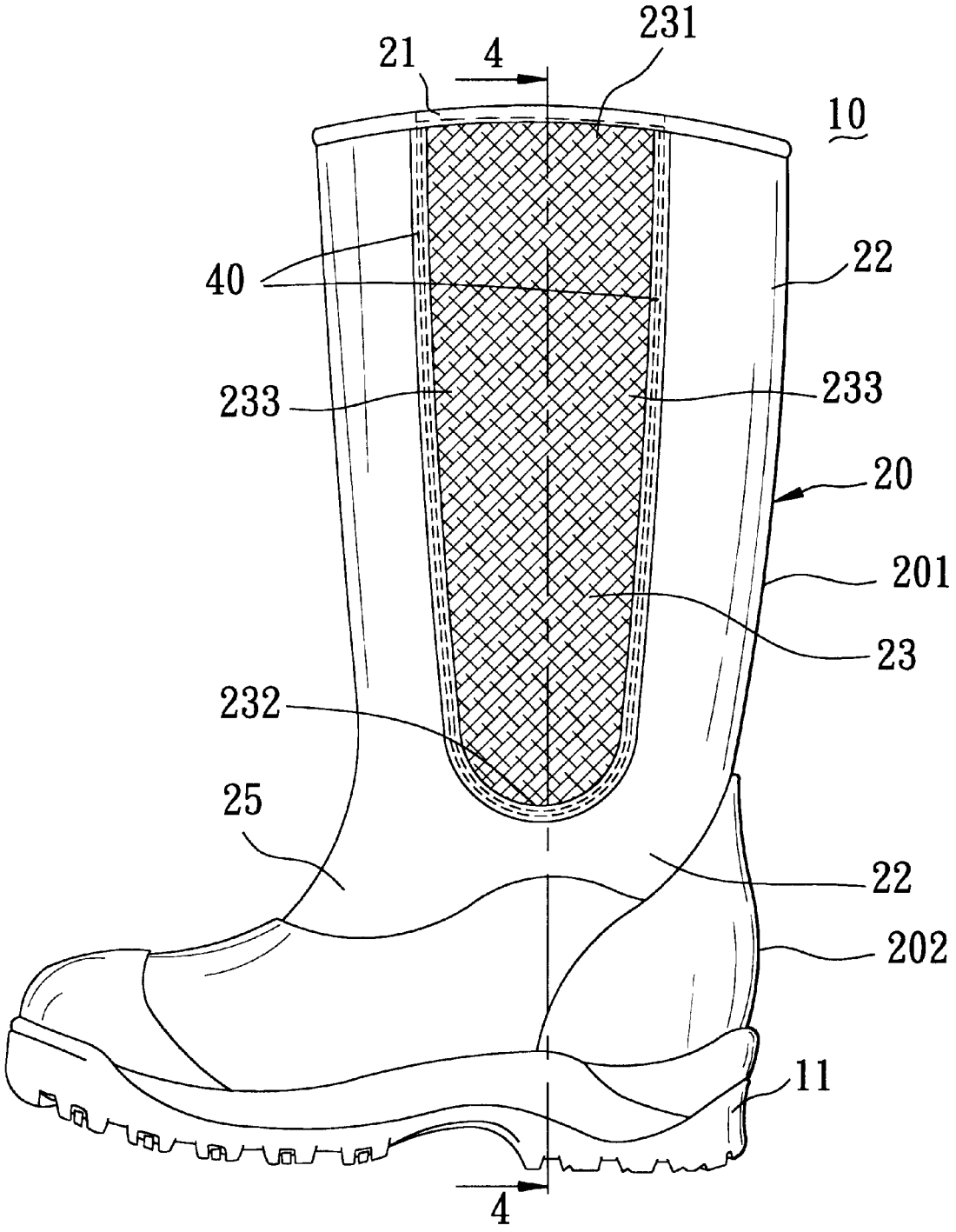
FIG. 2 is a side view of a boot embodying the present invention.
Figure 3:
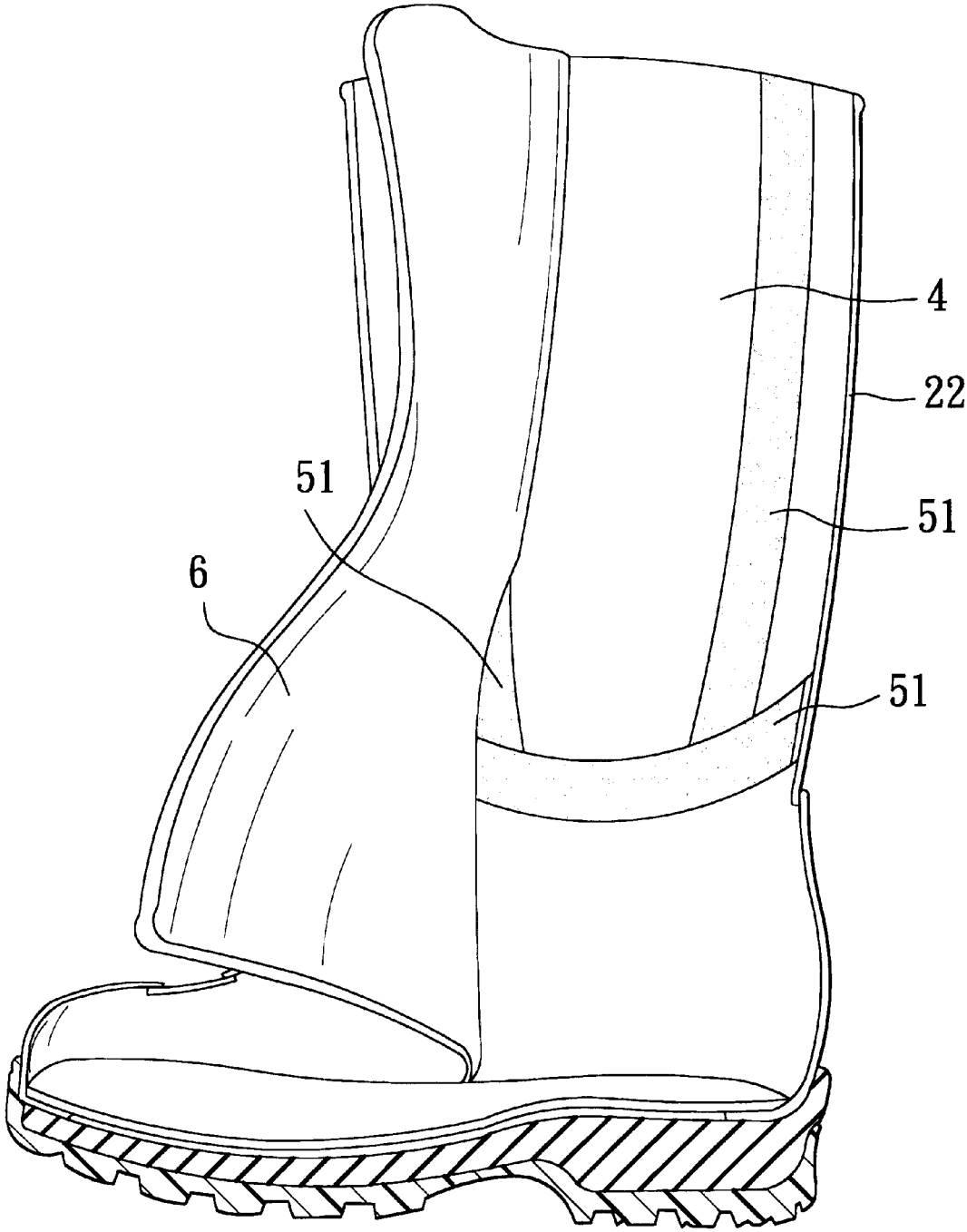
FIG. 3 is a sectional view of the boot of FIG. 2.

Referring to FIGS. 2, 3, 4 and 5, a knee boot 10 embodying the present invention is shown to include a shell 20 which has a foot portion 202 and an upper 201, and an outsole 11 connected to the foot portion 202. The shell 20 is composed of a waterproof first part 22 and two non-waterproof second parts 23. The two second parts 23 are arranged at the left and right sides of the upper 20. The first part 22 extends from a top open end 21 of the upper 201 to a bottom of the foot portion 202, and includes an entire part of the foot portion 202 and all parts of the upper 201 other than the second parts 23.

The first part 22 is made of a waterproof stretchable material which may be a rubber, such as a neoprene rubber having excellent stretchability. The second parts 23 are made of a non-waterproof air-pervious material, such as a fabric, or leather.

Each second part 23 has upper and lower margins 231, 232 interconnected by two opposite side margins 233 which extend along a direction from the top open end 21 to the foot portion 202. The upper margin 231 is arranged at the top open end 21 of the upper 20. The side margins 233 extend downward from two opposite ends of the upper margin 231. The lower margin 232 extends at a level adjacent to an ankle part 25 formed at the juncture of the upper 201 and the foot portion 202. The lower margin 232 and the side margins 233 are sewn to the first part 22. Alternatively, the second part 23 may be formed with any regular or irregular shape other than that shown in FIG. 2, but should have all of its margins sewn to the first part 22 as described above.

In order to make the knee boot 10 waterproof, each second part 23 is lined with a breathable or air-pervious, waterproof lining 4 which is made of an air-pervious waterproof material, such as a laminate well known as Goretex. The lining 4 is attached to the second part 23 in a loose fashion by being sewn to the second part 23 only along the side margins 233, the upper margin 231 and the lower margins 232 of the second part 23. Thus, all parts of the second part 23 other than the side margins 233, the upper margin 231 and the lower margin 232 are separate from the lining 4. The lining 4 may be sewn to the second part 23 before or after the second part 23 is sewn to the first part 22. Alternatively, the lining 4 and the second part 23 may be sewn to the first part 22 at the same time. Stitch connection seams 40 are formed where the second part 23 is sewn to the first part 22 and the lining 4.

Figure 4:
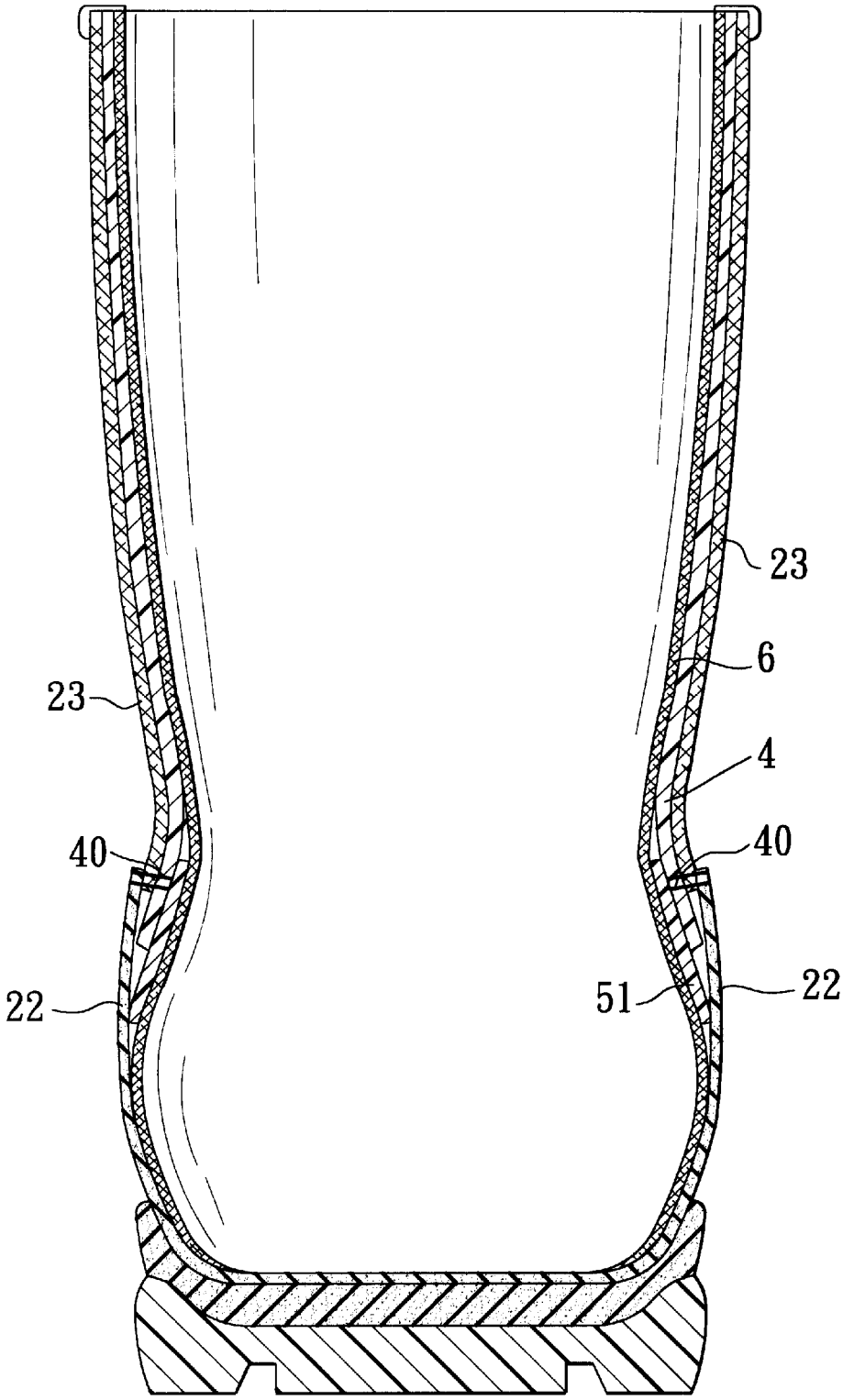
FIG. 4 is another sectional view taken along line 4—4 of FIG. 2.
Figure 5:
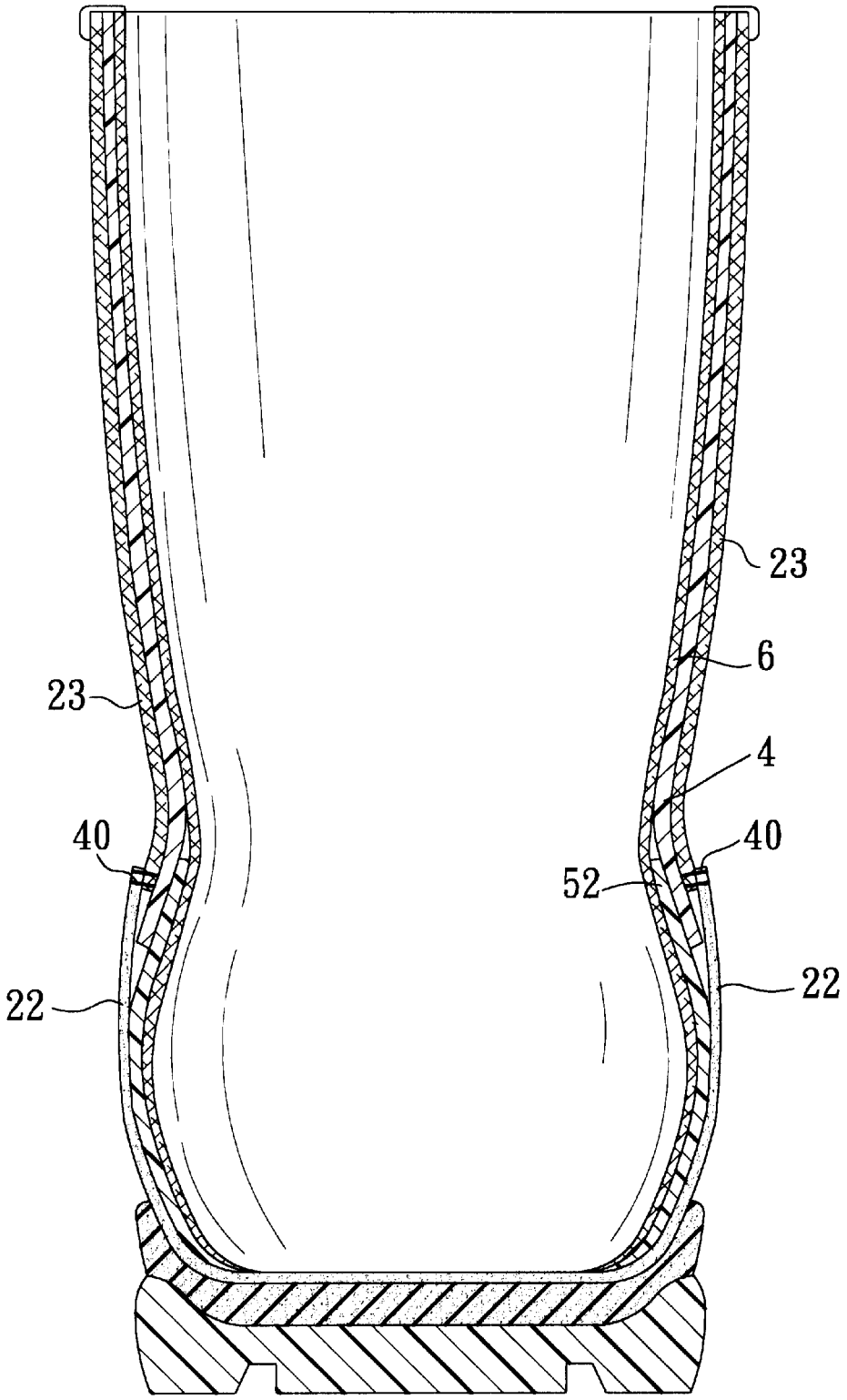
FIG. 5 is the same sectional view as FIG. 4 but with a waterproof tape extending to the bottom of a shell.

An innermost lining sleeve 6, which extends from the top open end 21 to the foot portion 202, is provided inside the shell 20 in a conventional manner. The seams 40 are sealed so as to be watertight by using waterproof seam sealing members. The waterproof seam sealing members may be waterproof tapes 51 each of which is configured as a strip, as shown in FIG. 4, to overly the corresponding seam 40. The waterproof seam sealing member may also be in the form of waterproof tapes 52 each of which is configured as a sheet, as shown in FIG. 5, that extends from the corresponding seam 40 to the bottom of the shell 20. Alternatively, the watertight sealing for the seams 40 may be accomplished by applying a waterproof sealing agent to the seams 40.

The front and rear first parts 22 made of the neoprene rubber contribute soft and stretchable characteristics to the knee boot 10 so that the knee boot 10 can be easily put on or taken off from the foot. In addition, owing to the use of the second parts 23 in combination with the linings 4 which are air pervious, the knee boot 10 can be kept dry and can permit the foot to breathe.

Figure 6:
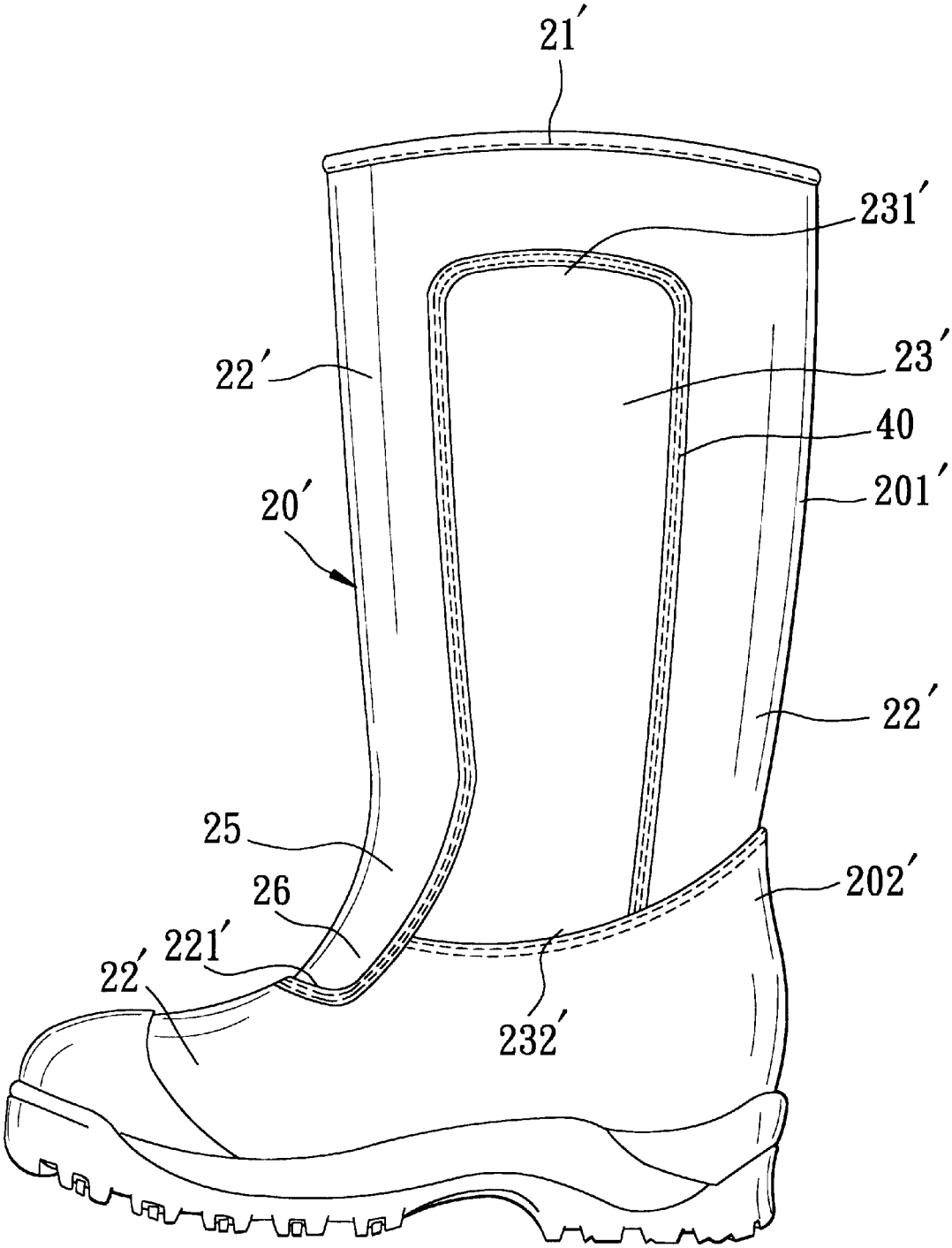
FIG. 6 shows another boot embodying the present invention.

Referring to FIG. 6, another embodiment of the present invention comprises a shell 20' which includes a waterproof first part 22' and two non-waterproof second parts 23'. The waterproof first part 22' includes a portion of an upper 201' and an entire portion of a foot portion 202'. The first part 22' in the upper 201' is made of a waterproof stretchable material such as a neoprene rubber. The first part 22' in the foot portion 202' is made of leather which is treated with a waterproof material so as to be waterproof and which is sewn to the upper 201'. The non-waterproof second parts 23' are respectively disposed at the left and right sides of the upper 201'. The second parts 23' in this embodiment differ from the second parts 23 of the previous embodiment in that the second parts 23' have upper margins 231' which are arranged below and spaced apart from the top open end 21' of the upper 201' and which are sewn to the first part 22'. The lower margin 232' of the second parts 23' is sewn to the top end of the foot portion 202'. At the front of the upper 201', the first part 22' has a lower end 221' that passes through an ankle part 25 to extend to an instep part 26. At the rear of the upper 201', the first part 22' extends to the ankle part 25. Due to the stretchable neoprene rubber in the first parts 22', the shell 20' is readily stretchable in a transverse direction at the ankle part 25 despite extension of the second parts 23' which are less stretchable or non-stretchable, to the ankle part 25. The stretchable ankle part 25 permits the foot to easily pass therethrough and enter the foot portion 202'. Like the previous embodiment, the non-waterproof second parts 23' are lined with a waterproof breathable lining (not shown) for waterproofing.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A boot comprising:

a shell which includes a foot portion with a bottom end, and an upper connected to said foot portion opposite to said bottom end, said upper having a top open end opposite to said foot portion, said shell being composed of a waterproof first part and at least one non-waterproof second part, said second part having an upper margin, a lower margin lower than said upper margin, and two opposite side margins connected to said upper and lower margins, said first part being connected to said second part at least along said side margins and said lower margin;

said first part being made of a waterproof stretchable material at least in said upper;

said second part being made of a non-waterproof air-pervious material;

a waterproof air-pervious lining underlying said second part and attached to said second part along said side margins and said upper and lower margins;

connection seams resulting from the connection of said first part and said lining to said second part; and waterproof seam sealing members disposed along said connection seams.

2. The boot as claimed in claim 1, wherein said first part is formed as an entire part of said foot portion and a part of said upper, and said second part is formed into the remaining part of said upper.

3. The boot as claimed in claim 1, wherein said second part is elongated along a direction from said top open end to said foot portion.

4. The boot as claimed in claim 1, wherein said second part is connected to said first part and said lining by a sewing process, and said connection seams are stitch connection seams.

5. The boot as claimed in claim 1, wherein said waterproof stretchable material is a neoprene rubber.

6. The boot as claimed in claim 2, wherein said first part is made of a neoprene rubber in both of said upper and said foot portion.

7. The boot as claimed in claim 2, wherein said first part is made of a neoprene rubber in said upper, but made of a waterproof material which is different from the neoprene rubber in said foot portion.

8. The boot as claimed in claim 7, wherein said shell includes a pair of said second parts which are respectively disposed at left and right sides of said upper.

9. The boot as claimed in claim 1, wherein said upper margin of said second part extends at said top open end of said upper.

10. The boot as claimed in claim 1, wherein said upper margin of said second part is arranged below said top open end of said upper.

11. The boot as claimed in claim 1, wherein said shell includes a pair of said non-waterproof second parts which are respectively disposed at left and right sides of said upper.

12. The boot as claimed in claim 4, wherein said waterproof seam sealing members are waterproof tapes which extend along said stitch connection seams.

13. The boot as claimed in claim 12, wherein said waterproof tapes further extend to a bottom of said foot portion from said stitch connection seams.

* * * * *